US007252486B2

(12) United States Patent
Huang

(10) Patent No.: US 7,252,486 B2
(45) Date of Patent: Aug. 7, 2007

(54) HAND-OPERATED INFLATOR

(76) Inventor: Ying-Che Huang, No. 111, Lane Tzeng-Fu, Tzeng-Tsuo Tsuen, Shiou-Shuei Shiang, Chang-Hua Hsien, 504 (TW)

( * ) Notice: Subject to any disclaimer, the term of this patent is extended or adjusted under 35 U.S.C. 154(b) by 387 days.

(21) Appl. No.: 11/068,958

(22) Filed: Mar. 2, 2005

(65) Prior Publication Data

US 2006/0198745 A1 Sep. 7, 2006

(51) Int. Cl.
*F04B 23/04* (2006.01)

(52) U.S. Cl. ..... 417/521; 417/531; 417/533; 417/538

(58) Field of Classification Search ..... 417/521, 417/531, 533, 538
See application file for complete search history.

(56) References Cited

U.S. PATENT DOCUMENTS 1,275,440 A * 8/1918 Johnson ..... 417/521
4,334,839 A * 6/1982 Flagg ..... 417/536
5,443,370 A * 8/1995 Wang ..... 417/238
5,533,436 A * 7/1996 Chuang ..... 92/146
6,350,112 B1 * 2/2002 Huang et al. ..... 417/521
6,935,850 B2 * 8/2005 Huang et al. ..... 417/524

* cited by examiner

*Primary Examiner*—Anthony D. Stashick
*Assistant Examiner*—Patrick Hamo
(74) *Attorney, Agent, or Firm*—Rabin & Berdo, P.C.

(57) ABSTRACT

A hand-operated inflator with dual cylinder is provided. Once the cylinders are pulled out on two sides of the central block to form a line axially, and a clamp plate at mid point in between the two cylinders is turned to the transversal position to lock the cylinders in place, the inflator is set for refilling operation. The two cylinders can be folded back when the clamp plate is released, making it easy for carrying and storage with the length reduced by half. The inflator is able to inflate an object with faster rate as compared with the conventional inflators with only one air cylinder. Moreover, the central block can be attached with a pressure meter. If the measured air pressure inside the object gets excessively high, air can be safely released through an over pressure valve.

17 Claims, 8 Drawing Sheets

HAND-OPERATED INFLATOR

BACKGROUND OF THE INVENTION

1. Field of the Invention

The present invention relates to a hand-operated inflator, and in particular to an inflator having dual cylinder design, so that an object can be inflated at a faster rate using less effort.

2. The Related Art

Generally, an air pump or hand-operated inflator is used to inflate tires, balloons, inflatable toys or other inflatable objects. Commonly seen hand-operated inflators have one air cylinder. The refilling of an inflatable object may take a long time and is not an easy task for ordinary users.

A recent design of the inflator employs two air cylinders, which is comprised of a base block and two cylinders coupled on two sides of the base block. The dual-cylinder inflator is attached with a discharge tube that has a mouthpiece on the other end for fitting on to the air nozzle of an inflatable object.

The dual-cylinder design is intended to expedite the refilling operation. The inflator uses the two pistons in the two air cylinders to compress the internal air at the same time, so that twice the amount of compressed air is generated in one stroke, as with the conventional one-cylinder inflator. The object can thus be fully inflated much faster than using the one-cylinder inflator.

However, the dual-cylinder inflator which boosts faster refilling might not be that attractive for ordinary users, as the dual-cylinder inflator is usually larger and weighs more than the one-cylinder inflator.

The air cylinders and the base block have to be assembled by thread mounting the air cylinders onto the base block. When the refilling is done, the dual-cylinder inflator is usually taken apart to save storage space. The assembling and disassembling of the dual-cylinder inflator may be quite troublesome, and, even when disassembled, all parts have to be kept in good order in order to use them again for the next time.

To overcome the above-mentioned problems, the present invention intends to provide an improved dual-cylinder inflator that is easy to use and small enough to be stored away conveniently.

SUMMARY OF THE INVENTION

The primary objective of the present invention is to provide an inflator with two foldable air cylinders, making it easy to use and maintain at the same time. Such inflator has two symmetrical cylinders on two sides, which are pivotally mounted on the central block, whereby the inflator can be completely set up simply by pulling out the two cylinders along respective pivot joints, with the two cylinders aligned on opposite sides of the central block to form a line axially.

With regard to the manner of operation, the user is to steadily push in the handles of the inflator with both hands, and the pistons compress the air in the dual cylinder and force the compressed air through the outlet of the central block into the inflatable object, so the object can be fully inflated with a faster than that using the single-cylinder inflator.

One of the main features of the present design is that the hand inflator employs two pivot joints to connect with the two cylinders. When in the expanded form, the two cylinders are rotated by 90 degrees in the expanding manner to form a line axially, whereas in the knocked down form, the cylinders are rotated by 90 degrees in the folding manner to save space.

When the inflator is set up, that is the cylinders and the central block are aligned to form a line axially, an internal air path from the cylinders to the central outlet is created passing through the interior of the central block, pivot pins, and cylinders.

The present invention is characterized in that the central block is attached with a pressure meter so that the air pressure in the object can be precisely monitored to get an appropriate pressure level. The hole on one side of the central block used to hold the pressure meter leads to internal space that communicates with longitudinal conduits in the pivot pins.

The present invention is also characterized in that the hand inflator is also be equipped with an over pressure valve. If the measured air pressure inside the object gets excessively high or reaches over a preset limit, air can be safely released through the over pressure valve.

The present invention is also characterized in that a clamp plate is used to hold the two cylinders in place after the cylinders are aligned on opposite ends of the central block.

In accordance with the present invention, to set up the inflator for refilling operation, the two symmetrical cylinders are rotated by 90 degrees in expanding manner, so that the two cylinders are aligned on opposite sides of the central block to form a line axially. The clamp plate is then rotated to the transversal position to lock the two cylinders in place in order to prevent waggling of the cylinders during the refilling operation.

To fold down the inflator, the clamp plate is rotated to the longitudinal position to allow the inflator to be folded down by rotating each cylinder 90 degrees in folding manner to form right angle with the central block. The length of the inflator in the knocked down form is almost half of the fully expanded form, thus making it easy to carry and to store away the inflator when not in use.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
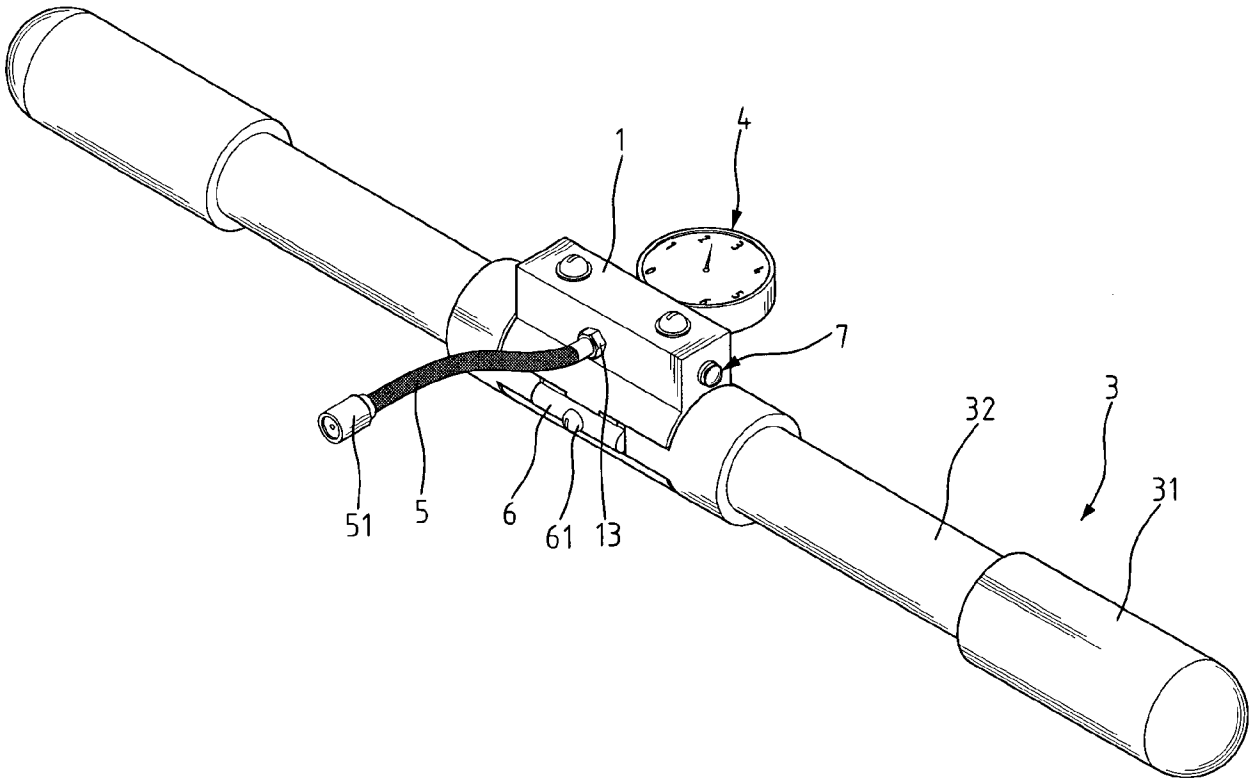
FIG. 1 is a perspective view of an inflator in accordance with the present invention.
Figure 2:
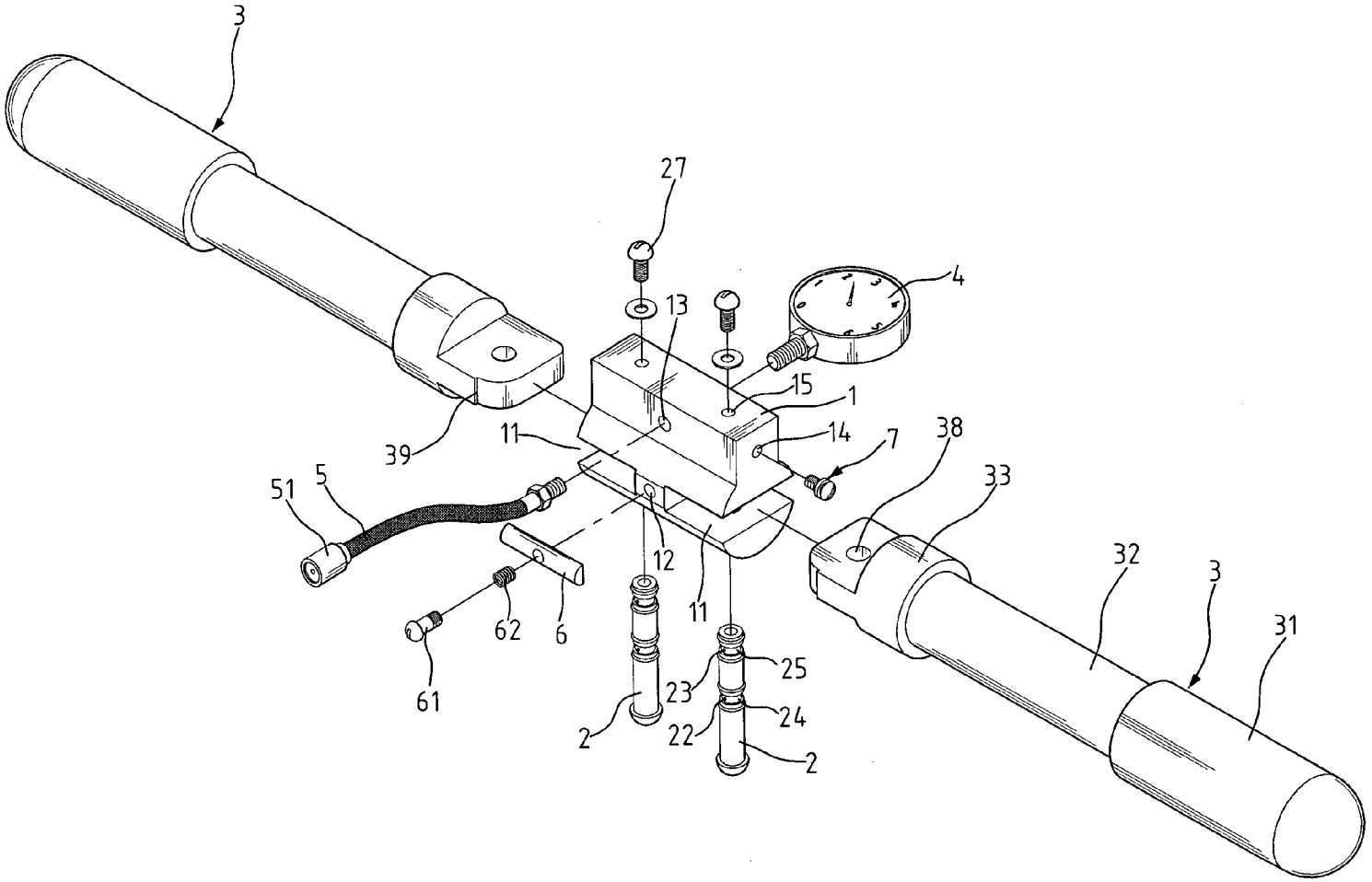
FIG. 2 is an exploded view of the inflator assembly.

A hand-operated inflator constructed in accordance with an preferred embodiment of the present invention as shown in FIGS. 1 and 2, comprises a central block 1, two pivot pins 2, and two cylinders 3 each having a free end forming a handle 31. The central block 1 has a discharge tube 5 attached to a central outlet 13 on the back surface, an pressure meter 4 mounted at the center point on the front surface, an over pressure value 7 received on one side, and two slots 11 formed on the lower portion of each side. The two cylinders 3 each having a protruded portion on one end are fitted into the slots 11 and rotatably connected by pivot pins 2.

In the air refilling process, the user can monitor the actual pressure inside the object through the pressure meter 4 as the object is being refilled. If the pressure inside the object gets excessively high, air pressure can be released by the over pressure valve 4 until the preset pressure is reached.

Figure 8:
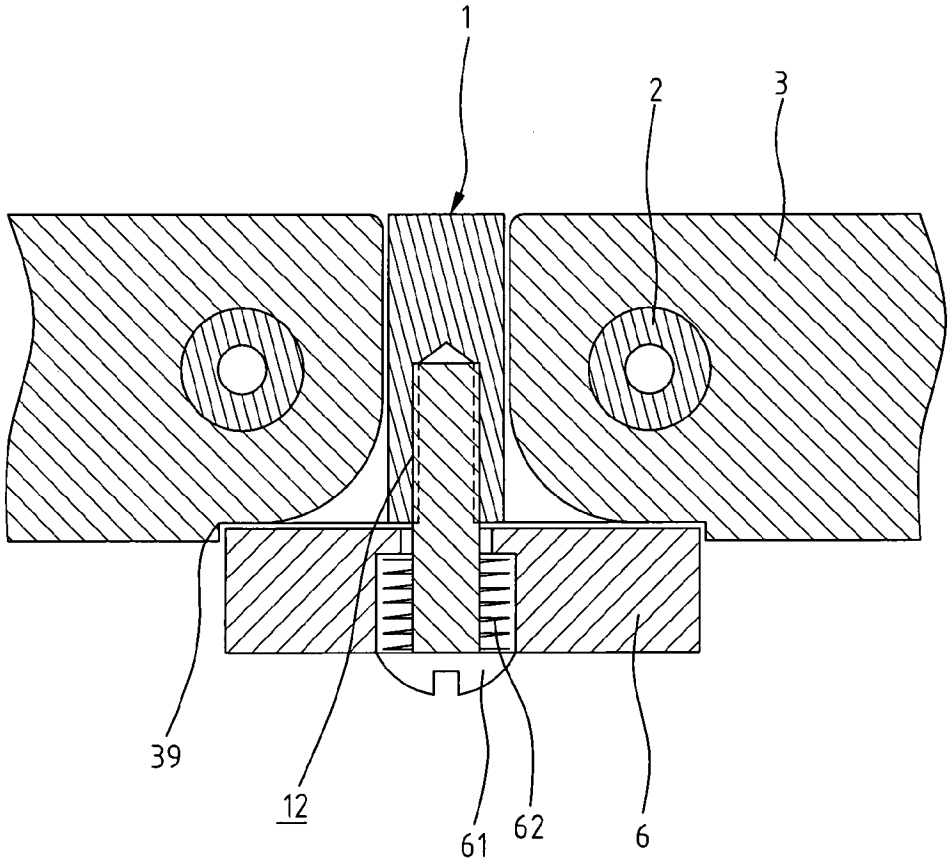
FIG. 8 is a sectional view of the clamp plate and the cylinders in locked position.

The inflator also has a hole 12 on the lower portion of the back surface of the central block 1, as shown in FIG. 8, at the mid point between the two cylinders 3, in which a screw 61 is inserted through a spring 62 to secure the clamp plate 6 with proper damping.

Figure 3:
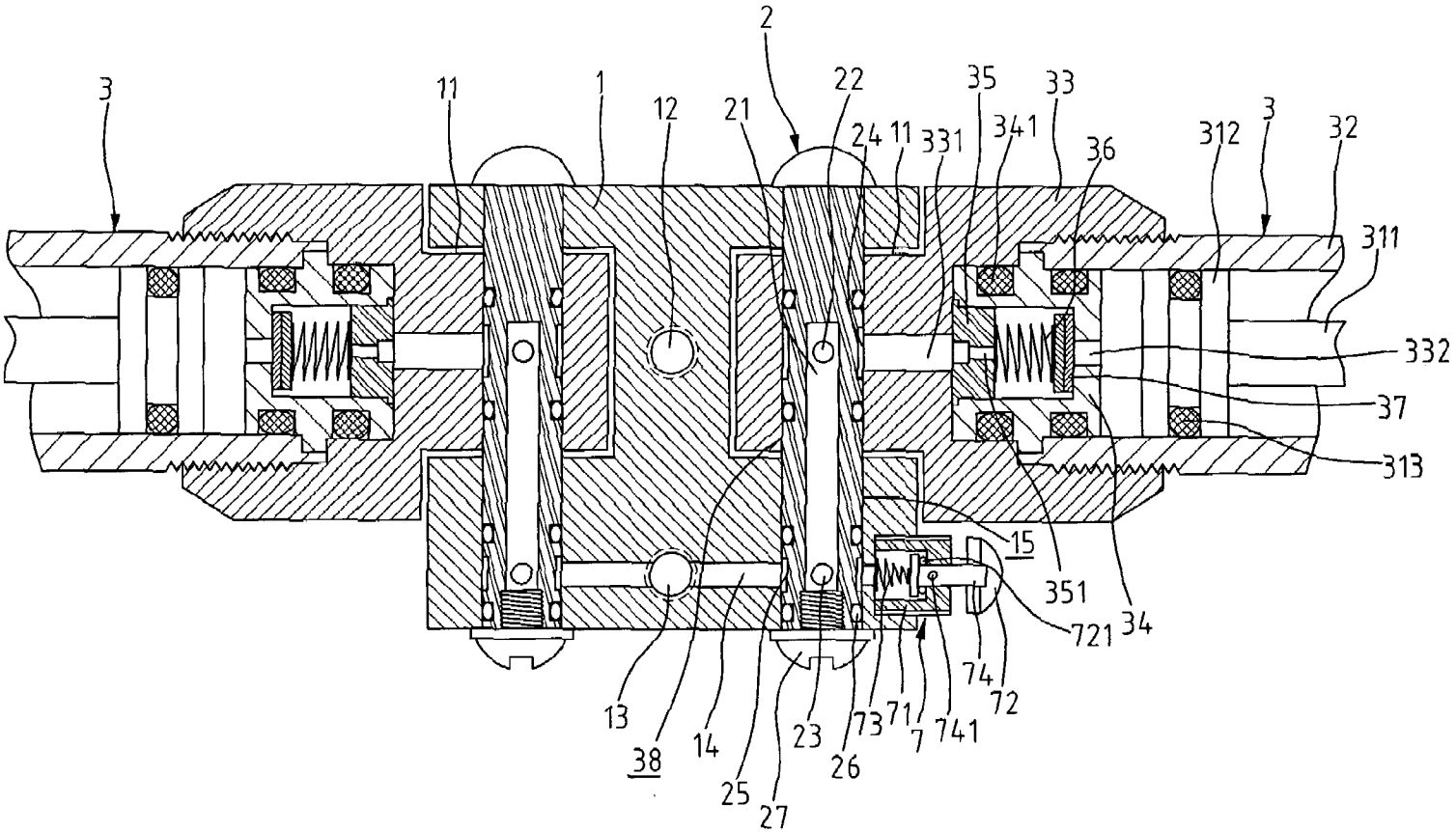
FIG. 3 is a sectional view showing internal structure of the main parts of the inflator.

Referring to FIGS. 2 and 3, there are two through holes 15 beginning from the top surface to the bottom surface that pass through the internal space and the slot cavity 11 of the central block 1, respectively corresponding to the two pivot pins 2 which are inserted from the bottom holes 15 into the central block 1. Two screws 27 with gaskets are respectively inserted into the top holes 15 to secure one end of the pivot pins 2 inserted through the bottom holes 15.

The through hole 14 on one side of the central block 1 used to receive an over pressure valve 7 is to communicate with the two through holes 15 at the internal intersection points.

The hole (not shown) on the front surface of the central block 1, opposite to the central outlet 13 on the back surface, is used for mounting the pressure meter 4.

Referring to FIG. 8, the clamp plate 6 is rotatably mounted by a screw 61 on the back side surface of the central block 1, so that the clamping plate 6 can be rotated to the transversal position to fit into the indent 39 on the outer rim of each cylinders 3 after the cylinders 3 are expanded to form a line axially, so that the clamp plate 6 can be rotated to the transversal position to hold down the two cylinders 3 to prevent any waggling of the cylinders 3 during the refilling operation. If the clamp plate 6 is rotated to the longitudinal position, the cylinders 3 can be folded down to form a right angle with the central block 1, thus the length of the extended inflator is almost reduced by half.

Each one of the two pivot pins 2 is built in with a longitudinal conduit 21 passing through the hollow core in the extension portion. Each pivot pin 2 has a first circular band recess 24 around the neck of the conduit 21, and a second circular band recess 25 near the open end, wherein the first circular band recess 24 has a hole 22 on the bottom surface, and the second circular band recess 25 also has a hole 23 on the bottom surface, whereby the holes 22, 23 communicate with each other through the longitudinal conduit 21 running through the axis of the pivot pin 2. The circular band recesses 24/25 are each blocked by a pair of O-rings 26 to prevent air leakage in the gap between the pivot pin 2 and the through hole 15, and the free end of the longitudinal conduit 21 in each of the two pivot pins 2 is sealed off by a screw 27, which is used to secure the cylinder 3 in place.

Figure 4:
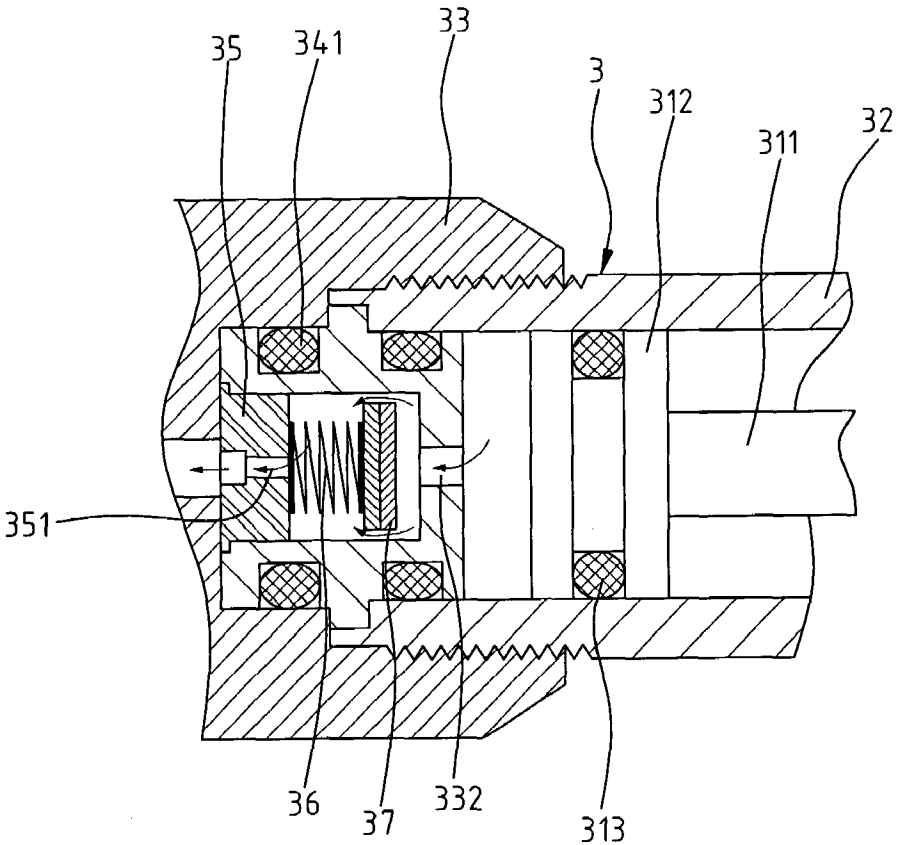
FIG. 4 is a sectional view of part of the cylinder.

Referring to FIG. 4, each cylinder 3 comprises a cylindrical body 32, a central shaft 311 connected by a piston 312 on one end and a handle 31 on the other end, and a header 33. One end of the cylindrical body 32 is to receive a valve block 34, wherein a spring 36 is placed between a movable plug 37 and a circular pad 35 to form a check valve in order to prevent air flow in the reverse direction.

When the two cylinders 3 and the clamp plate 6 are aligned on the opposite side of the central block in a line axially, the position of the first circular band recess 24 corresponds to the central conduit of the 331 of the header 22 of the cylinder 3, and the second circular band recess 25 corresponds to the transversal through hole 14 of the central block, thereby the longitudinal conduits 21 in the pivot pin 2 communicate with the transversal through hole 14 extending from the lateral wall of the central block 1 to reach the second longitudinal through hole 15, and the longitudinal conduits 21 in the pivot pins 2 communicate with the central conduits 331 of the cylinders 3 on two sides, so that an internal air passage is created in the inflator bridging by the longitudinal conduits 21.

The cylindrical body 32 has threads on one end of the external surface, and the header 33 has corresponding threads on the inner wall of the cup-shaped portion, so that the header 33 can be coupled onto one end of the cylindrical body 32 that holds the check valve 34.

The other end of the header 33 is provided with a protruded portion for fitting into the slot 11 of the central block 1. The protruded portion has a through hole 38 from the top surface to the bottom surface for pivotally connecting the cylinder 3. The protruded portion of the cylinder 3 also has an indent 39 on the outer rim to accommodate the rotatable clamp plate 6.

The protruded portion of the header 33 is fitted into one of the two slots 11 of the central block 1, and rotatably joined by the pivot pin 2, so that one end of the cylinder 3 is pivotally connected with the central block 3 on each side.

There is a hole 351 in the center of the circular pad 35 that allows the inner space of the valve block 34 to communicate with the through hole 351, and further through another hole 331 in the header 33, the inner space of the valve block 34 is able to communicate with the second circular band recess. When the movable plug 37 is pushed out by the compressed air, the central conduit 332 in the cylindrical body 32 is able to communicate with the inner space of the valve block 34. In such manner, compressed air flows from the two cylinders 3 to the central outlet 13 by way of the central conduit 332, through hole 351, through hole 331, first circular band recess 24, hole 22, longitudinal conduit 21, hole 23, second circular band recess 25, and transversal through hole 14 in that sequential order.

To assemble the cylinder 3 in accordance with one preferred embodiment of the invention, the protruded portion of the header 33 is first inserted into the slot 11, with the through hole 38 aligned with the longitudinal through hole 15, and then the pivot pin 2 is inserted from the bottom of the central block 1, passing through the through hole 38, with the extension portion completely covered by the central block 1, and then the screw 27 is inserted from top hole 15 to secure the open end of the pivot pin 2.

Figure 5:
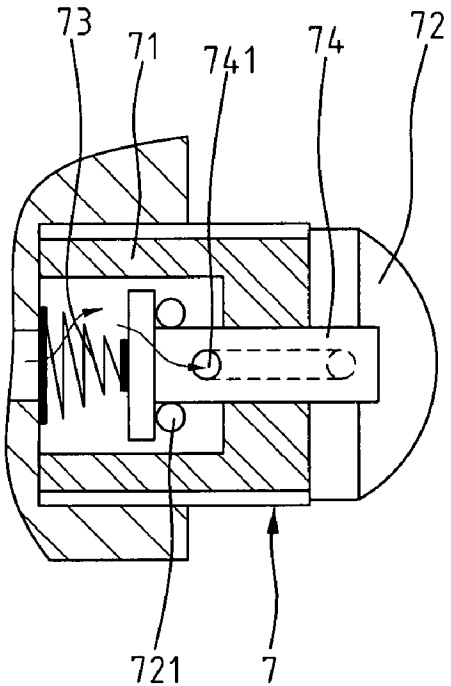
FIG. 5 is a sectional view of an over pressure valve.

Referring to FIG. 5, the over pressure valve 7 comprises a metal body 71, one side of which is cup shaped with hollow interior to receive a spring 73 and an actuating shaft 74 that has first and second relief holes 741 internally interconnected. One end of the actuating shaft 74 abuts on a button 72, and the other end of the shaft 74 is attached with a plug 721, which is placed over the spring 73. In the normal conditions, the shaft 74 under the mechanical force of the spring 73 thrusts outward to seal off the first relief hole 741 on the actuating shaft 74 of the metal body 71, and the second relief hole 741 is exposed outside the metal body 71. When the button 72 is depressed, the plug 721 is pushed inward against the spring 73, so that the first relief valve 741 is pushed into the metal body 71, to allow the compressed air to be channeled through the two relief valves 741 of the shaft 74 and released to the outside.

Figure 6:
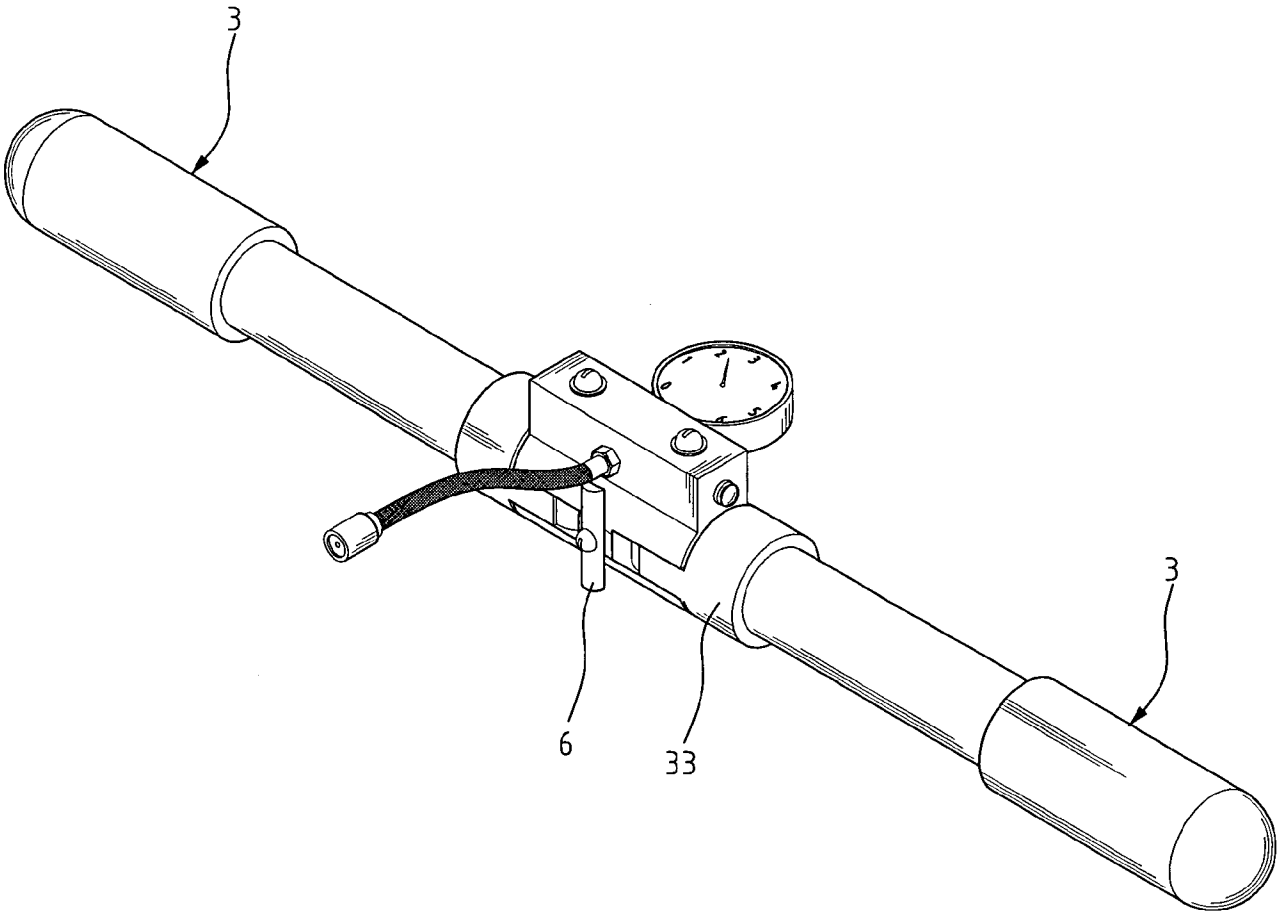
FIG. 6 is a diagram of the inflator with a clamp plate in longitudinal position (unlocked)
Figure 7:
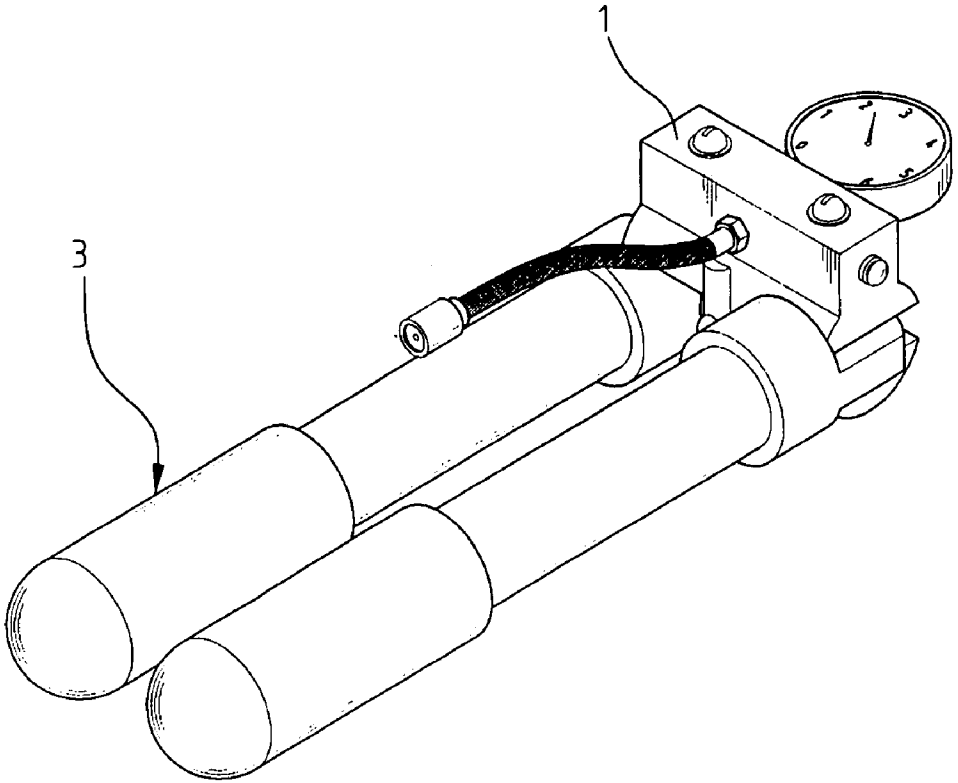
FIG. 7 is a diagram of the inflator in knocked down form when not in use.

To fold down the inflator, the clamp plate 6 is rotated to the longitudinal position, and the clamp plate 6 is removed from the slot 11 opening (as shown in FIG. 6), so that the two cylinders 3 can be rotated by 90 degrees in the folding manner to form right angle with the central block 1 (as shown in FIG. 7). The length of the inflator can be reduced almost by half.

To set up the inflator, the two cylinders 3 are rotated by 90 degrees in expanding manner so that the two cylinders 3 and the central block 1 of the inflator are aligned on the opposite sides of the central block 1 to form a line axially. The clamp plate 6 is then rotated to the transversal position, fitting into the indent 39 on the outer rim of the cylinder 3 to hold the cylinders 3 in place to prevent waggling of the cylinder 3 during the refilling operation.

With regard to the manner of operation, the user is to use the inflator by holding the right handle 31 of the inflator with the right hand, and the left handle 31 of the inflator with the left hand, and then steadily pushing in the handles 31 axially, to cause the pistons 312 to travel from one end to the other end and compress the air inside the cylindrical body 32.

The compressed air respectively pushes open the plug 37 of the check valve 34 on each side of the central block 1, the air thus enters the inner space of the check valves 34, and further through the through hole 351 of the pad 35, the air flows to the first circular band recess 24, which then enters through the hole 22 into the longitudinal conduit 21 inside the pivot pin 2, which is channeled through the hole 23 on the second circular band recess 25 to enter the transversal through hole 14, and eventually passes through the central outlet 13 into the inflatable object.

When the push-in force on the handle 31 is released, the piston 312 respectively returns to the normal position, and the depressed spring 36 rebounds and pushes against the plug 37 to seal off the hole to the conduit 332 to prevent any back flow of the air stream.

Referring to FIG. 5, when the object is being inflated, the user can simultaneously monitor the pressure meter 4 as the object is being inflated. If the pressure gets excessively high, the user can depress the over pressure valve 7 to release excess air pressure until the preset air pressure is obtained.

When the button 72 is depressed to activate the over pressure valve 7, the plug 721 is pushed away against the spring 73, and at the same time, the relief hole 741 on the shaft 74 is moved into the internal space of the metal body 71, to enable air pressure in the central block 1 to be released through the first and second relief holes 741 to the outside.

One of the innovative features of the present invention over the conventional designs is that the hand-operated inflator employs two pivot joints to rotatably connect one of the two air cylinders on each side of the central block. When the inflator is in the expanded form, the two cylinders are rotated by 90 degrees in the expanding manner to be aligned on opposite sides of the central block for the refilling operation, and in the knocked down form, the cylinders are rotated by 90 degrees in the folding manner to save space for storage and transport.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A hand-operated inflator comprising:

a central block which has two longitudinal through holes extending from top to bottom surface to receive two screws inserted from the top and two pivot pins inserted from the bottom, one relief hole on one side to receive an over pressure valve, sealing one end of the transversal through hole that communicates with two longitudinal conduits inside the pivot pins, and a central outlet on back surface of the central block to attach a discharge tube with nozzle on the other end, another hole on the lower portion of the back side to rotatably receive a clamp plate, and a hole on the front surface to receive a pressure meter; and two pivot pins each of which has a longitudinal conduit running through the hollow core, a first circular band recess around the neck and a second circular band recess around the open end, wherein the first circular band recess is provided with a first hole on the bottom surface, and the second circular band recess with a second hole on the bottom surface, both of which communicate with each other through the longitudinal conduit inside the pivot pins, and each circular band recess is blocked by a pair of O-rings; wherein the pivot pins are respectively inserted through bottom holes of the cylinders, so that the position of the first circular band recess corresponds to the central hole of the cylindrical body, and the second circular band recess corresponds to the transversal through hole of the central block.

2. The hand-operated inflator as claimed in claim 1, wherein the central block has two slots on two sides to receive a cylinder on each side pivotally connected to the central block by a pivot pin passing through a series of through holes in the central block and the protruded portion of the cylinder longitudinally.

3. The hand-operated inflator as claimed in claim 1, wherein the pivot pin has a longitudinal conduit through the hollow core, having one end permanently sealed off and extending to the other open end with inward threads on the inner wall, so that the pivot pin is inserted from the bottom hole of the central block to reach almost the top surface of the central block, and a screw is then inserted through the top hole to secure the pivot pin in place.

4. The hand-operated inflator as claimed in claim 2, wherein the pivot pin has a longitudinal conduit through the hollow core, having one end permanently sealed off and extending to the other open end with inward threads on the inner wall, so that the pivot pin is inserted from the bottom hole of the central block to reach almost the top surface of the central block, and a screw is then inserted through the top hole to secure the pivot pin in place.

5. The hand-operated inflator as claimed in claim 1, wherein the central block has an over pressure valve installed in a hole over on one side.

6. The hand-operated inflator as claimed in claim 2, wherein the central block has an over pressure valve installed in a hole over on one side.

7. The hand-operated inflator as claimed in claim 5, wherein the over pressure valve is comprised of a metal body, a button on one end abutting on an actuating shaft having two relief holes that extends into the cup-shaped portion of the metal body with a plug on the other end, a spring is placed in the cup-shaped portion to abut on the plug, so as to seal the relief hole of the shaft from the outside, wherein after the button is depressed, the plug is pushed inward to allow one of the relief holes to move inside the metal body to create an air path to the outside, so compressed air can be released through the relief holes to the outside.

8. The hand-operated inflator as claimed in claim 6, wherein the over pressure valve is comprised of a metal body, a button on one end abutting on an actuating shaft having two relief holes that extends into the cup-shaped portion of the metal body with a plug on the other end, a spring is placed in the cup-shaped portion to abut on the plug, so as to seal the relief hole of the shaft from the outside, wherein after the button is depressed, the plug is pushed inward to allow one of the relief holes to move inside the metal body to create an air path to the outside, so compressed air can be released through the relief holes to the outside.

9. The hand-operated inflator as claimed in claim 1, wherein the central outlet has inward thread for fitting a discharge tube.

10. The hand-operated inflator as claimed in claim 1, wherein the central block is provided with a clamp plate, which is rotatably mounted on the back surface with damping spring, wherein the clamp plate is rotated to the transversal position and fitted into indent on the outer rim of the cylinder to enable the two cylinders to be locked in place for refilling operation.

11. The hand-operated inflator as claimed in claim 2, wherein the central block is provided with a clamp plate, which is rotatably mounted on the back surface with damping spring, wherein the clamp plate is rotated to the transversal position and fitted into indent on the outer rim of the cylinder to enable the two cylinders to be locked in place for refilling operation.

12. The hand-operated inflator as claimed in claim 10, wherein the central block has a hole on the lower portion of the back surface, at the mid point between the two slots, in which a spring is placed into the hole, and a screw is then inserted through the spring to secure the clamp plate on the central block with damping.

13. The hand-operated inflator as claimed in claim 11, wherein the central block has a hole on the lower portion of the back surface, at the mid point between the two slots, in which a spring is placed into the hole, and a screw is then inserted through the spring to secure the clamp plate on the central block with damping.

14. The hand-operated inflator as claimed in claim 1, wherein the cylinder is comprised of a cylindrical body; a central shaft attached with a piston on one end and a handle on the other end, a check valve installed on one end of the cylindrical body, which has a spring placed between a movable plug and a circular pad to seal a central hole to prevent back flow of the air stream, and a header mounted over one end of the cylindrical body, wherein the central hole on one end of the header corresponds to the central conduit.

15. The hand-operated inflator as claimed in claim 14, wherein the header has a cup-shaped portion with inward thread on the open end, so that the header can be mounted over one end of the cylindrical body to house the check valve in the cup-shaped portion of the header, and the header also has a protruded portion on the other side to be inserted into one of the two slots on the central block to create a pivotal joint.

16. The hand-operated inflator as claimed in claim 15, wherein the outer rim on the protruded portion has an indent on the outer rim of the cylinder to receive the rotatable clamp plate.

17. The hand-operated inflator as claimed in claim 1, wherein the central block is provided with a hole on the front surface opposite to the clamp plate for mounting a pressure meter.

* * * * *